US008678576B2

(12) United States Patent
Edombingo et al.

(10) Patent No.: US 8,678,576 B2
(45) Date of Patent: Mar. 25, 2014

(54) FLUID CONTAINER WITH BUBBLE ELIMINATOR

(75) Inventors: Miguel Almirol Edombingo, Dipolog (PH); Sulpecio Hagnaya Escuña, Jr., Masbate (PH); Robin Ian Paran Vivas, Lipa (PH)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 13/517,675

(22) Filed: Jun. 14, 2012

(65) Prior Publication Data

US 2013/0335492 A1 Dec. 19, 2013

(51) Int. Cl.
*B41J 2/19* (2006.01)

(52) U.S. Cl.
USPC ..... 347/92

(58) Field of Classification Search
USPC ..... 347/92
See application file for complete search history.

(56) References Cited

U.S. PATENT DOCUMENTS 8,057,021 B2 * 11/2011 Silverbrook ..... 347/85

FOREIGN PATENT DOCUMENTS

SU 727680 * 4/1980 ..... C12B 1/18

* cited by examiner

*Primary Examiner* — Matthew Luu
*Assistant Examiner* — Michael Konczal
(74) *Attorney, Agent, or Firm* — Amster, Rothstein & Ebenstein LLP

(57) ABSTRACT

A container for holding a volume of fluid includes a first fluid chamber having an entry port and a bubble eliminator with at least one bubble-piercing protrusion for pricking bubbles as the volume of fluid flows through the bubble eliminator. The container further includes a second fluid chamber in fluid communication with the first fluid chamber for receiving the volume of fluid from the first fluid chamber.

28 Claims, 8 Drawing Sheets

FLUID CONTAINER WITH BUBBLE ELIMINATOR

FIELD OF THE DISCLOSURE

The present disclosure relates generally to micro-fluid applications, such as inkjet printing. The present disclosure relates particularly to a fluid container having a bubble eliminator to burst bubbles and vent the air to atmosphere.

BACKGROUND

The art of printing images with micro-fluid technology is relatively well-known. In thermal inkjet printing technology, thermal inkjet printers apply ink to a print medium by ejecting small droplets of ink from an array of nozzles located in a printhead. An array of thin-film resistors on an integrated circuit on the printhead selectively generates heat as current is passed through the resistors. The heat causes ink contained within an ink reservoir adjacent to the resistors to boil and be ejected from the array of nozzles associated with the resistor array. A printer controller determines which resistors will be "fired" and the proper firing sequence thus controlling the ejection of ink through the printhead so that the desired pattern of dots is printed on the medium to form an image.

For the ink supply, ink in thermal inkjet printers using an on-carrier ink supply system may be contained in printhead cartridges which include integrated ink reservoirs. The printhead cartridges are mounted on the carriage which moves the printhead cartridges across the print medium. The integrated ink reservoirs often contain less ink than the printhead is capable of ejecting over its life. Several methods now exist for supplying additional ink to the printhead after the initial supply in the integrated reservoir has been depleted. Most of these methods involve continuous or intermittent siphoning or pumping of ink from a remote ink source to the print cartridge.

The remote ink source is typically housed in a replacement ink container which is "off-carrier," meaning it is not mounted on the carriage which moves the printhead cartridge across the print medium. In an off-carrier ink supply system, the ink usually travels from the remote ink container to the printhead through flexible conduits extending from the replacement ink container to the printhead cartridge. Before actual use of the inkjet printer, the flexible conduits are filled with air which must be removed from the system prior to usage of the inkjet printer. In conventional inkjet printers, the air is removed by priming wherein the air is removed from the flexible conduits through the nozzle holes by a suction force and for a predetermined period. During priming, it is unavoidable that a certain volume of ink is sucked together with the air. The ink sucked during priming is discarded as waste ink. After initial use of the inkjet printer, air accumulates in the flexible conduits when the inkjet printer is idle or not in use for an extended period of time. The accumulated air is removed by purging. Priming and purging refer to the same process, the only significant difference being the time the process is employed. Priming is performed during initial use of a printhead while purging is employed during regular operation of the printhead. Both priming and purging remove air from the flexible conduits and discard a certain volume of ink as waste ink.

Accordingly, a need exists in the art for a system of removing air from ink supply line without wasting ink.

SUMMARY

The above-mentioned and other problems become solved with an ink recirculation system having a bubble eliminator adapted to prick the bubbles as the fluid passes through at least one fluid path.

The ink recirculation system of the present invention includes an ink container including a housing defining an interior to retain the volume of ink. The interior includes a first fluid chamber having an entry port for receiving the volume of ink from an ink supply. The first fluid chamber has a bubble eliminator defined by at least one ink path, the at least one ink path including at least one bubble piercing protrusion for pricking bubbles as the volume of ink flows through the at least one ink path.

The ink recirculation system also includes a second fluid chamber in fluid communication with the first fluid chamber for receiving the volume of ink from the first fluid chamber. The second fluid chamber has an exit port for delivering the volume of ink outside the container. The volume of ink is then pumped and delivered to at least one print head in fluid communication with the container and adapted to eject ink along a print medium within the inkjet printer. Instead of priming or purging, ink, together with the air, in the flexible conduits is recirculated back to the ink container. Ink and air enters the first fluid chamber and flows into at least one ink path where air, in the form of bubbles, is pricked by the at least one bubble piercing protrusion disposed along the at least one ink path. Air is then released to atmosphere through a vent. Ink then flows to the second fluid chamber and is supplied back to the inkjet printer.

BRIEF DESCRIPTION OF THE DRAWINGS

The accompanying drawings incorporated in and forming a part of the specification, illustrate several aspects of the present disclosure, and together with the description serve to explain the principles of the present disclosure. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the present disclosure. It is to be understood that other embodiments may be utilized and that process, electrical, and mechanical changes, etc., may be made without departing from the scope of the present disclosure. The following detailed description, therefore, is not to be taken in a limiting sense and the scope of the present disclosure is defined only by the appended claims and their equivalents.

Figure 1:
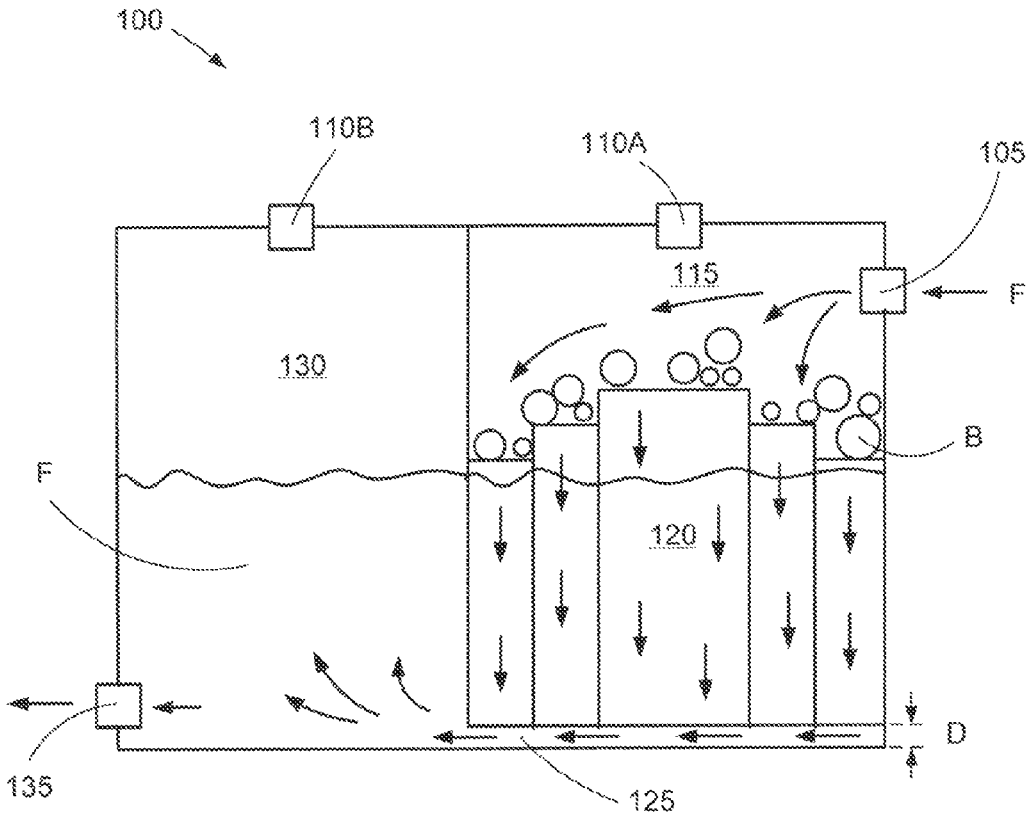
FIG. 1 is a diagrammatic view of a fluid container according to an embodiment of the present invention.

With reference to FIG. 1, a container 100 of the ink recirculation system according to an embodiment of the present disclosure is shown. Fluid F enters the container 100 through the entry port 105 and flows into the first fluid chamber 115. The fluid F then passes through the bubble eliminator 120 where the air bubbles B in the fluid F are pierced. Air bubbles B burst when pierced and the air is vented to atmosphere through the vent 110A. Fluid F then flows towards the gap 125 after passing the bubble eliminator 120. The gap 125 is defined by a clearance D of about 0.5 mm to about 50 mm between the bubble eliminator 120 and a bottom surface of the container 100. From the gap 125, fluid F then flows towards the second fluid chamber 130. The second fluid chamber 130 includes a vent 110B to vent air to atmosphere. Fluid F in the second fluid chamber 130 flows out of the container 100 through the exit port 135.

Figure 2:
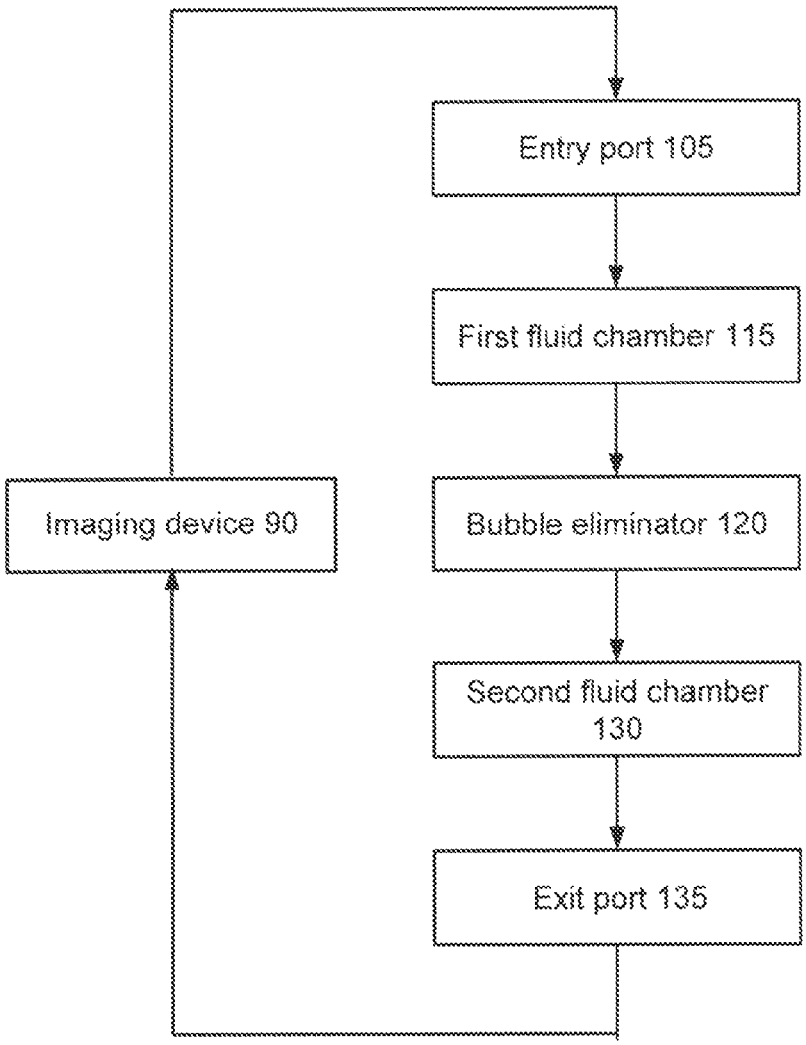
FIG. 2 is a flow diagram charting the path of fluid flow in the fluid recirculation system according the embodiment of FIG. 1.

FIG. 2 is a flow diagram charting the path of fluid flow in the fluid recirculation system according the embodiment of FIG. 1. The recirculation process replaces the process of priming or purging. From the imaging device 90, fluid F flows through the entry port 105 of the container 100. Fluid F coming from the imaging device 90 carries along air bubbles B obtained during the recirculation process. The fluid F then enters the first fluid chamber 115 and flows through the bubble eliminator 120 where air bubbles B are pierced. Fluid F then flows toward the second fluid chamber 130. Fluid F, without the air bubbles B is then supplied back to the imaging device 90 through the exit port 135.

Figure 3:
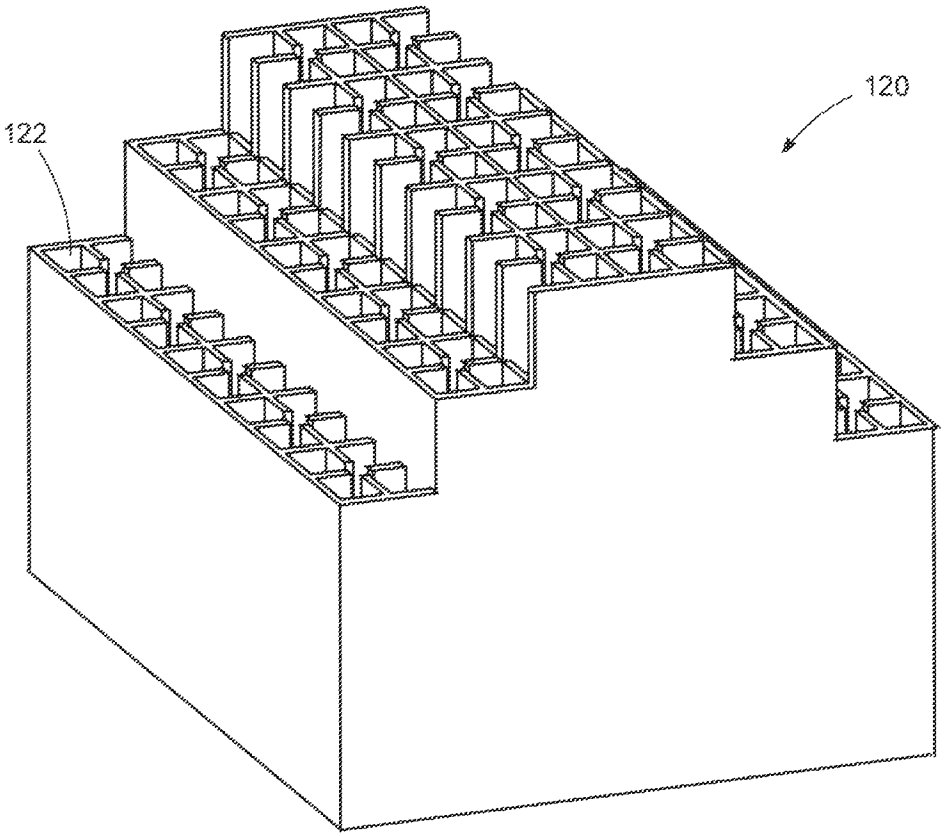
FIG. 3 is a diagrammatic view of the bubble eliminator according to an example embodiment of the present invention.

FIG. 3 is a diagrammatic view of the bubble eliminator 120 according to an example embodiment of the present invention. As shown, the bubble eliminator 120 is defined by a plurality of fluid paths 122 of varying heights arranged symmetrically, with the fluid paths 122 of greater height being disposed at the center of the bubble eliminator 120.

Figure 4C:
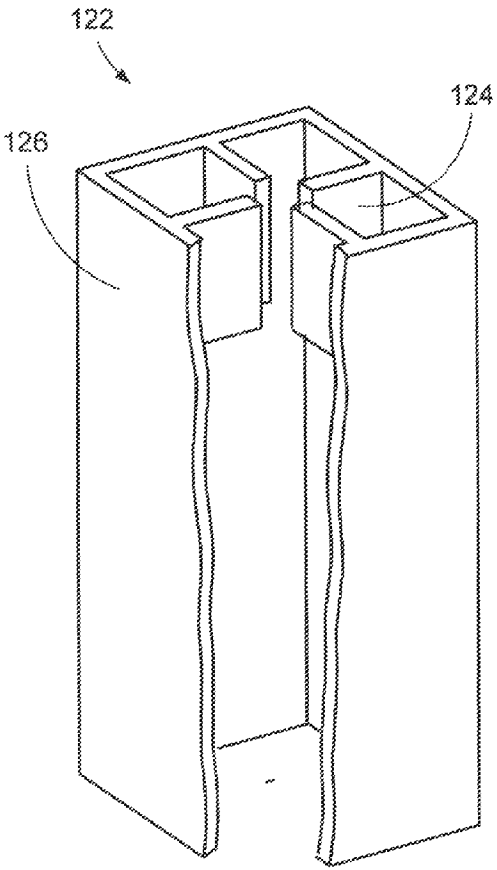
FIGS. 4A, 4B and 4C are diagrammatic views depicting fluid paths according to different embodiments of the present invention.
Figure 4B:
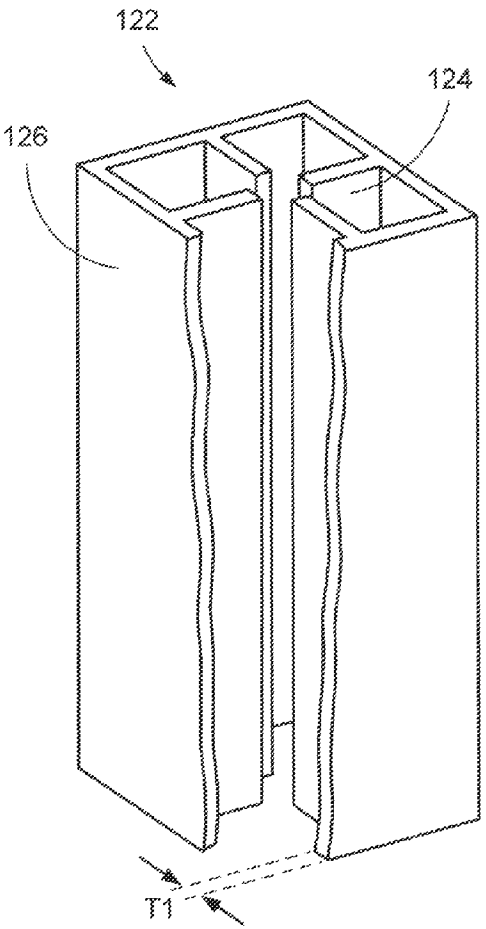
Figure 4A:
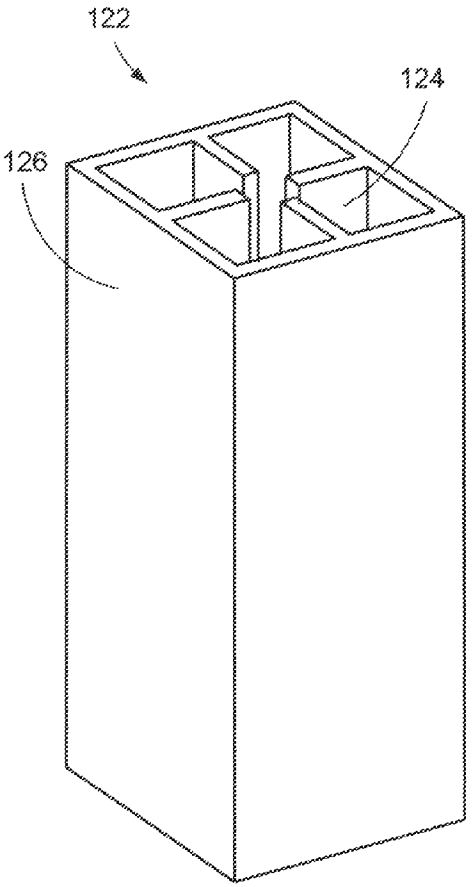

FIGS. 4A, 4B and 4C are diagrammatic views depicting fluid paths 122 according to different embodiments of the present invention. FIG. 4A depicts a fluid path 122 defined by a tubular segment 126 having bubble piercing protrusions 124 protruding from an inner surface of the tubular segment 126. In one example embodiment, the tubular segment 126 is a square tube having sides of about 2.0 mm to about 40 mm. In another example embodiment, the tubular segment 126 is a round tube having a diameter of about 2 mm to about 40 mm.

FIG. 4B is a cut-away view of the fluid path 122 of FIG. 4A depicting the bubble piercing protrusions 124 extending along the entire length of the tubular segment 126. FIG. 4B further shows the tubular segment 126 having a thickness T1 of about 0.5 mm to about 5 mm.

FIG. 4C is a cut-away view of a fluid path 122 including bubble piercing protrusions 124 extending along a portion of the entire length of the tubular segment 126. Of course, the present invention is capable of other embodiments where the tubular segment 122 includes bubble piercing protrusions 124 of differing lengths.

Figure 5C:
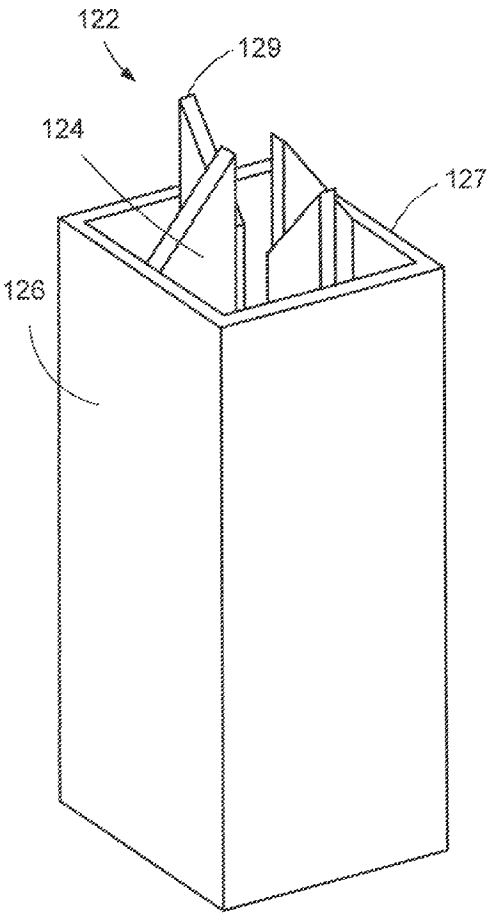
FIGS. 5A, 5B and 5C are diagrammatic views depicting features of exemplary bubble piercing protrusions.
Figure 5B:
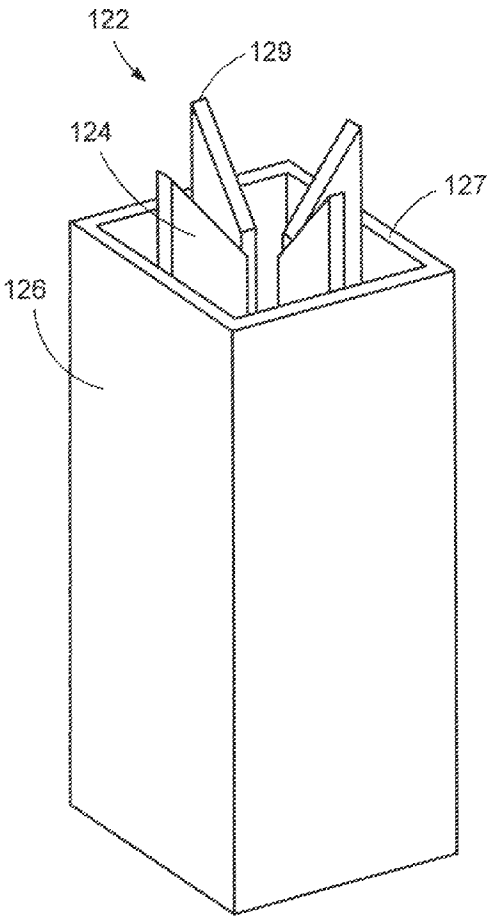
Figure 5A:
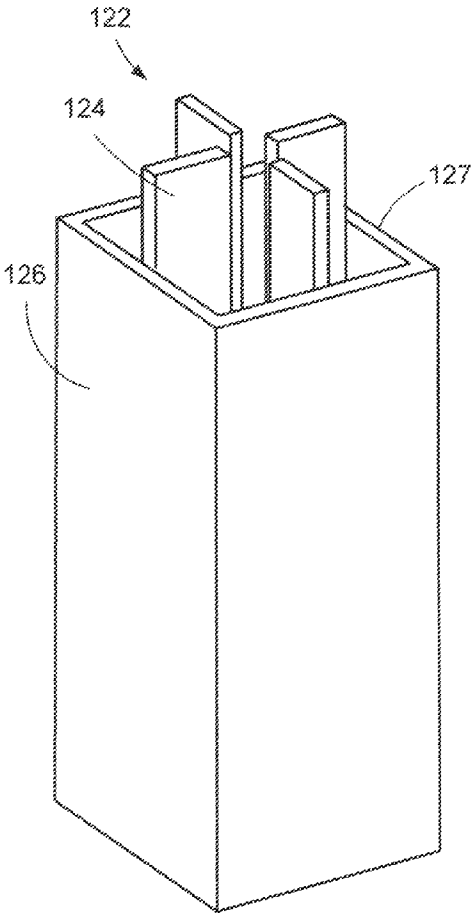

FIGS. 5A, 5B and 5C are diagrammatic views depicting features of exemplary bubble piercing protrusions 124. FIGS. 5A, 5B and 5C depict the bubble piercing protrusions 124 extending beyond the length of the tubular segment 126. FIG. 5A shows the bubble piercing protrusions 124 of FIGS. 4A, 4B and 4C extending beyond an upper end 127 of the tubular segment 126. Another example embodiment of the bubble piercing protrusion 124 is shown on FIG. 5B, the bubble piercing protrusion 124 having a sharp corner 129 for piercing air bubbles B flowing through the tubular segment 126. FIG. 5C depicts a possible arrangement of the bubble piercing protrusions 124 of FIG. 5B. Of course, other embodiments employing different arrangements and combinations of the bubble piercing protrusions 124 are possible without going outside the scope of the present invention.

Figure 6B:
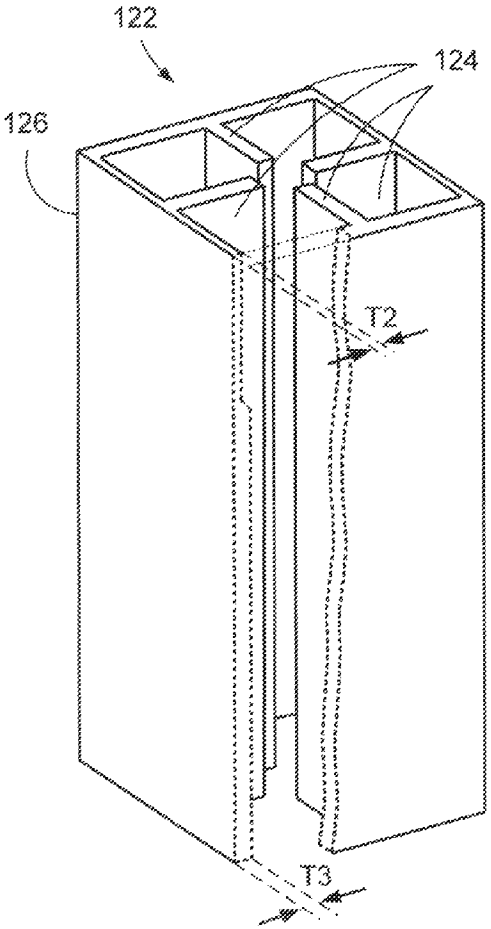
FIGS. 6A and 6B are diagrammatic views of the fluid path according to one embodiment of the present invention.
Figure 6A:
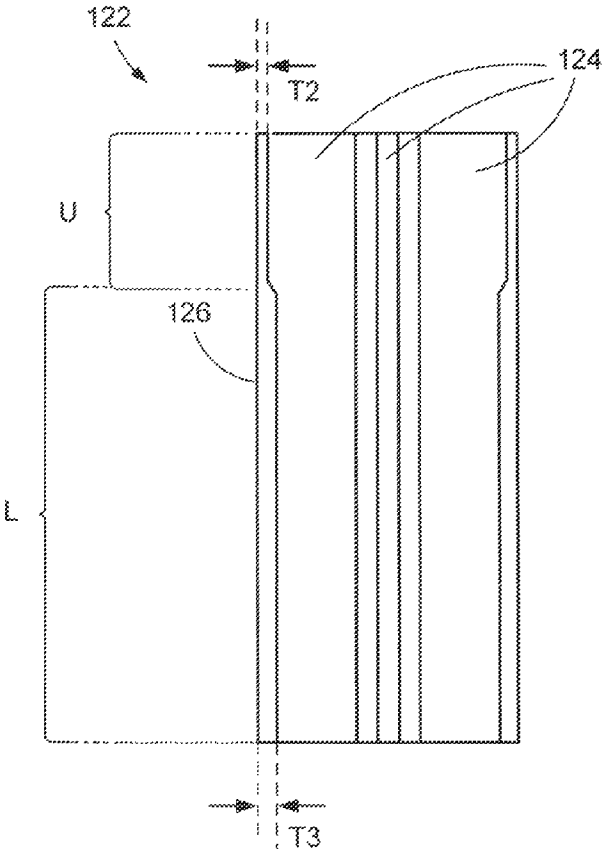

FIGS. 6A and 6B are diagrammatic views depicting another example embodiment of the tubular segment 126. In this example embodiment, the tubular segment 126 includes a proximate end U having a thickness T2 and a distal end L having a thickness T3. The thickness T2 is lesser than the thickness T3 to enable slicing of air bubbles B as they come in contact with the proximate end U. In another example embodiment, thickness T2 is about 0.5 mm to about 1.0 mm.

Figure 7B:
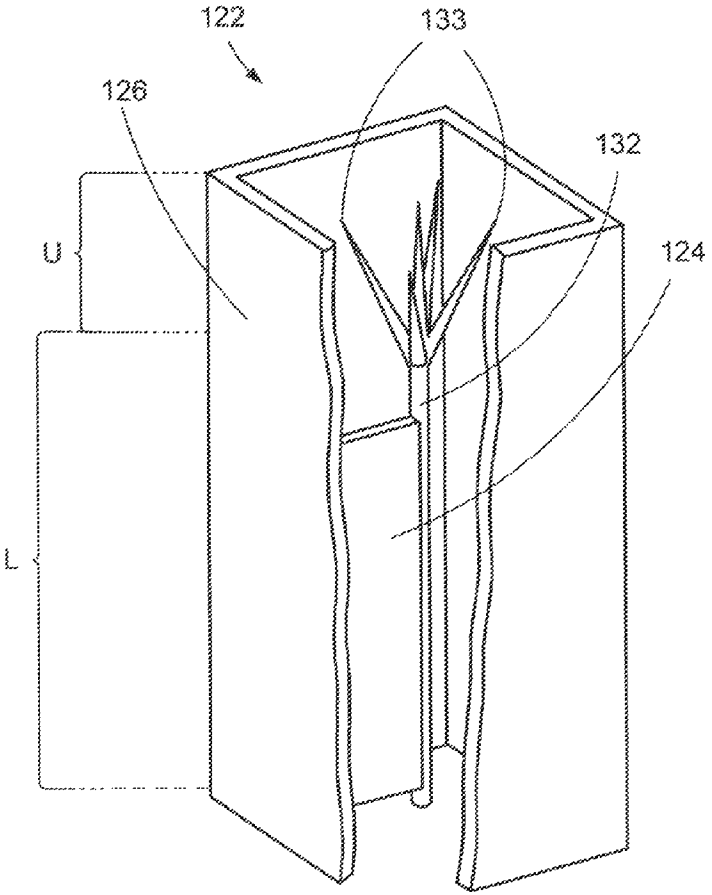
FIGS. 7A and 7B are diagrammatic views of other example embodiments of the fluid path according to the present invention.
Figure 7A:
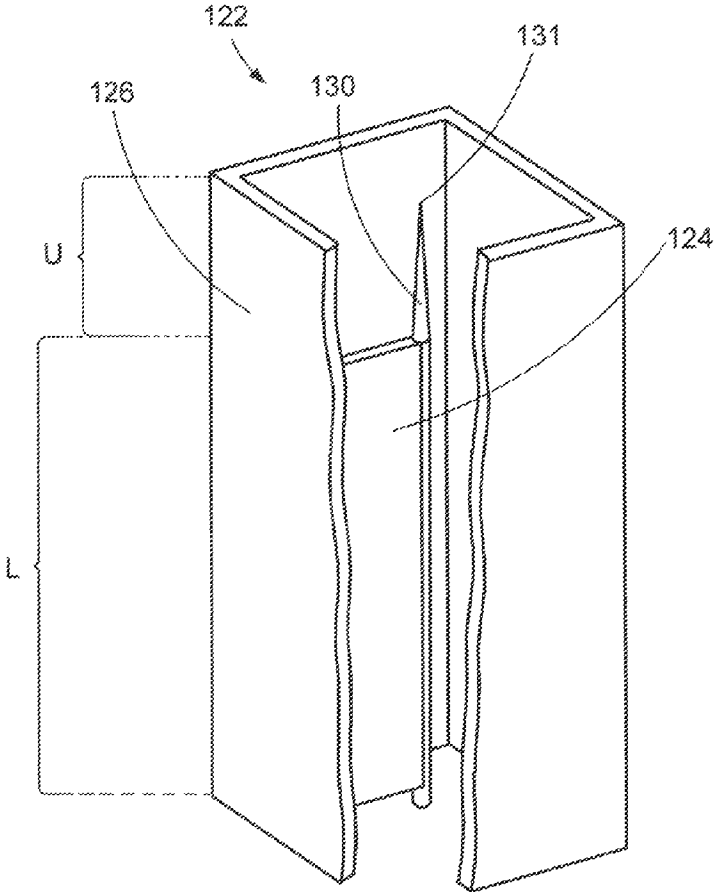

FIGS. 7A and 7B are diagrammatic views of other example embodiments of the fluid path 122 according to the present invention. FIG. 7A depicts the fluid path 122 having a bubble piercing protrusion 124 including at least one needle 130 having a pointed end 131 directed towards the proximate end U of the tubular segment 126. FIG. 7B depicts the fluid path 122 having a bubble piercing protrusion 124 including at least pointed component 132 having at least one prong 133 for pricking air bubbles B flowing through the fluid path 122.

Figure 8B:
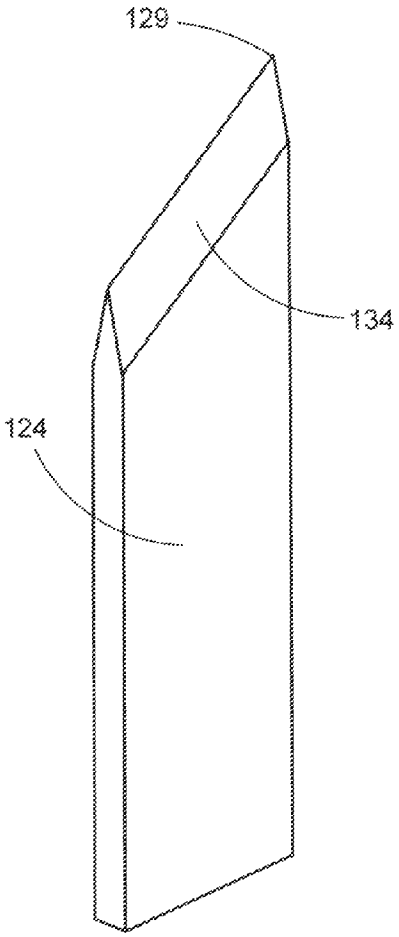
FIGS. 8A and 8B are diagrammatic views of other example embodiments of the bubble piercing protrusion.
Figure 8A:
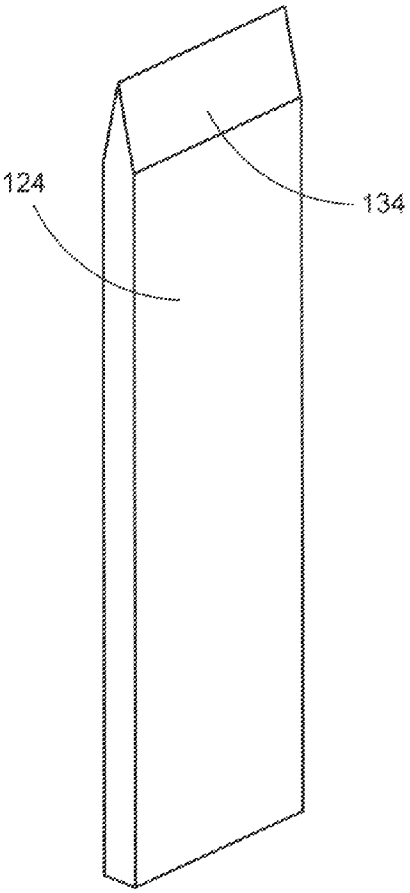

FIGS. 8A and 8B are diagrammatic views of other example embodiments of the bubble piercing protrusion 124. FIG. 8A depicts a bubble piercing protrusion 124 having a sharp edge 134 for slicing and piercing bubbles B as they come in contact with the bubble piercing protrusion 124. FIG. 8B depicts another example embodiment of the bubble piercing protrusion 124 having a sharp edge 134 and a sharp corner 129 for pricking bubbles B as fluid F flows through the fluid path 122.

The foregoing illustrates various aspects of the present invention. It is not intended to be exhaustive. Rather, it is chosen to provide the best illustration of the principles of the present invention and its practical application to enable one of ordinary skill in the art to utilize the present invention, including its various modifications that naturally follow. All modifications and variations are contemplated within the scope of the present invention as determined by the appended claims. Relatively apparent modifications include combining one or more features of various embodiments with features of other embodiments.

The invention claimed is:

1. A container to hold a volume of fluid, comprising:

a housing defining an interior to retain the volume of fluid;

a first fluid chamber within the interior of the housing and having an entry port for receiving the volume of fluid from a fluid supply, the first fluid chamber further including at least one bubble piercing protrusion disposed for pricking bubbles as the volume of fluid flows through the first fluid chamber; and a second fluid chamber within the interior of the housing and in fluid communication with the first fluid chamber for receiving the volume of fluid from the first fluid chamber, the second fluid chamber having an exit port for delivering the volume of fluid outside the container.

2. The container of claim 1, wherein the first fluid chamber further includes a bubble eliminator having a tubular segment defining at least one fluid path and including the at least one bubble piercing protrusion.

3. The container of claim 2, wherein the tubular segment has proximate and distal ends for conveying the fluid from the entry port toward the second fluid chamber.

4. The container of claim 3, wherein the at least one bubble piercing protrusion extends outside the proximate end of the tubular segment.

5. The container of claim 3, wherein the tubular segment at the distal end is thicker than at the proximate end.

6. The container of claim 3, wherein the at least one bubble piercing protrusion is disposed on an inner surface of the tubular segment.

7. The container of claim 6, wherein the at least one bubble piercing protrusion is a pair of opposing blades disposed along the tubular segment.

8. The container of claim 6, the tubular segment being a square tube, wherein the at least one bubble piercing protrusion is two pairs of opposing blades, each disposed on one side of the square tube.

9. The container of claim 2, wherein the bubble eliminator maintains a gap from a bottom surface of the first fluid chamber.

10. The container of claim 9, wherein the gap ranges from about 1 millimeter to about 3 millimeter.

11. The container of claim 2, wherein the at least one fluid path is a plurality of tubular segments of differing heights.

12. The container of claim 6, the tubular segment being a square tube, wherein the at least one bubble piercing protrusion is at least one pointed component having a pointed end directed towards the proximate end of the tubular segment.

13. The container of claim 1, wherein the at least one bubble piercing protrusion is at least one needle having at least one prong disposed along at least one fluid path.

14. The container of claim 1, wherein the at least one bubble piercing protrusion is at least one blade disposed along at least one fluid path having a thickness of about 0.5 mm to about 1 mm.

15. A fluid supply system for a printer, comprising:

a container to hold a volume of fluid including, a housing defining an interior to retain the volume of fluid;

a first fluid chamber within the interior and having an entry port for receiving the volume of fluid from a fluid supply, the first fluid chamber further including at least one bubble piercing protrusion disposed for pricking bubbles as the volume of fluid flows through the first fluid chamber; and a second fluid chamber within the interior and in fluid communication with the first fluid chamber for receiving the volume of fluid from the first fluid chamber, the second fluid chamber having an exit port for delivering the volume of fluid outside the container;

at least one print head in fluid communication with the container and adapted to eject fluid along a print medium within the printer; and a fluid pump including a fluid inlet in fluid communication with the container, a fluid outlet in fluid communication with the at least one print head, and a pump actuator for at least initiating displacement of fluid through the fluid pump upon actuation.

16. The fluid supply system of claim 15, wherein the first fluid chamber further includes a bubble eliminator having a tubular segment defining at least one fluid path and including the at least one bubble piercing protrusion.

17. The fluid supply system of claim 16, wherein the tubular segment has proximate and distal ends for conveying the fluid from the entry port toward the second fluid chamber.

18. The fluid supply system of claim 17, wherein the at least one bubble piercing protrusion extends outside the proximate end of the tubular segment.

19. The fluid supply system of claim 17, wherein the tubular segment at the distal end is thicker than at the proximate end.

20. The fluid supply system of claim 17, wherein the at least one bubble piercing protrusion is disposed on an inner surface of the tubular segment.

21. The fluid supply system of claim 20, wherein the at least one bubble piercing protrusion is a pair of opposing blades disposed along the tubular segment.

22. The fluid supply system of claim 20, the tubular segment being a square tube, wherein the at least one bubble piercing protrusion is two pairs of opposing blades, each disposed on one side of the square tube.

23. The fluid supply system of claim 16, wherein the bubble eliminator maintains a gap from a bottom surface of the first fluid chamber.

24. The fluid supply system of claim 23, wherein the gap ranges from about 1 millimeter to about 3 millimeter.

25. The fluid supply system of claim 16, wherein the at least one fluid path is a plurality of tubular segments of differing heights.

26. The fluid supply system of claim 20, the tubular segment being a square tube, wherein the at least one bubble piercing protrusion is at least one pointed component having a pointed end directed towards the proximate end of the tubular segment.

27. The fluid supply system of claim 15, wherein the at least one bubble piercing protrusion is at least one needle having at least one prong disposed along at least one fluid path.

28. The fluid supply system of claim 15, wherein the at least one bubble piercing protrusion is at least one blade disposed along at least one fluid path having a thickness of about 0.5 mm to about 1 mm.

* * * * *